United States Patent [19]

Hastings et al.

[11] Patent Number: 4,521,757

[45] Date of Patent: Jun. 4, 1985

[54] HIGH SPEED ELECTROMAGNETIC MECHANICAL SWITCH

[75] Inventors: Jerome K. Hastings, Sussex; James H. Bigelow; Robert L. Pearson, both of Milwaukee, all of Wis.

[73] Assignee: Eaton Corporation, Cleveland, Ohio

[21] Appl. No.: 406,615

[22] Filed: Aug. 9, 1982

[51] Int. Cl.[3] ..... H01H 51/24

[52] U.S. Cl. ..... 335/79; 335/126; 335/173; 335/176; 335/186; 335/86; 335/188; 335/193

[58] Field of Search ..... 335/136, 180, 188, 256, 335/257, 258, 266, 79, 86, 126, 173, 176, 186, 193

[56] References Cited

U.S. PATENT DOCUMENTS

| | | | |
|---|---|---|---|
| 1,523,759 | 1/1925 | Dougherty . | |
| 1,571,401 | 2/1926 | Erickson . | |
| 1,603,005 | 10/1926 | Flam . | |
| 1,605,824 | 11/1926 | Erickson . | |
| 1,700,029 | 1/1929 | Dady et al. . | |
| 2,082,121 | 6/1937 | Rypinski | 335/256 |
| 2,322,911 | 6/1943 | Beam | 137/144 |
| 2,332,911 | 10/1943 | Hausler | 200/67 D |
| 2,417,438 | 3/1947 | O'Brien et al. | 335/256 |
| 2,446,855 | 8/1948 | Seibel | 335/256 |
| 2,469,976 | 5/1949 | Miller | 200/67 D |
| 2,598,856 | 6/1952 | Swan et al. | 200/67 D |
| 2,629,791 | 2/1953 | Tourneau | 200/67 D |
| 2,967,983 | 1/1961 | Danklefs | 335/256 |
| 3,040,217 | 6/1962 | Conrad | 335/256 |
| 3,183,410 | 5/1965 | Flora | 335/256 |
| 3,242,283 | 3/1966 | Clements | 335/188 |
| 3,260,814 | 7/1966 | Turnbull | 200/67 D |
| 3,354,274 | 11/1967 | Bauer | 200/67 D |
| 3,426,800 | 2/1969 | Bauer | 137/608 |
| 3,743,898 | 7/1973 | Sturman | 335/268 |
| 3,784,943 | 1/1974 | Markowitz et al. | 335/266 |
| 3,900,822 | 8/1975 | Hardwick et al. | 335/256 |
| 3,983,351 | 9/1976 | Bauer | 200/83 |
| 4,010,769 | 3/1977 | De Lorenzo et al. | 137/312 |
| 4,142,553 | 3/1979 | Sakakibara et al. | 251/75 |
| 4,165,762 | 8/1979 | Acar | 251/75 |
| 4,253,493 | 3/1981 | English | 335/266 |
| 4,254,313 | 3/1981 | Baader | 200/67 D |
| 4,320,371 | 3/1982 | Coyle et al. | 335/266 |
| 4,422,060 | 12/1983 | Matsumoto | 335/256 |

FOREIGN PATENT DOCUMENTS

| | | | |
|---|---|---|---|
| 112064 | 9/1964 | Czechoslovakia . | |
| 1046223 | 10/1966 | United Kingdom | 200/67 D |

OTHER PUBLICATIONS

Roters

*Primary Examiner*—William H. Beha, Jr.
*Assistant Examiner*—Jeffrey Sterrett
*Attorney, Agent, or Firm*—Andrus, Sceales, Starke & Sawall

[57] ABSTRACT

A high speed electromagnetically actuated electromechanical switch is provided by a bistable electric snap blade operated by an electromagnetic actuator. A magnetically permeable yoke directs the flux paths of a pair of coaxial coils. An armature plunger shuttles axially reciprocally in the coils between first and second positions. The snap blade has a pair of cantilever arms extending towards each other to engage the armature plunger in the gap therebetween for lateral flexing actuation. Energization of a given coil provides a primary flux path around that coil through the yoke and the armature plunger, and provides a secondary flux path around both coils through the yoke and the armature plunger. The primary flux path force around either coil is always stronger than the secondary path.

4 Claims, 3 Drawing Figures

HIGH SPEED ELECTROMAGNETIC MECHANICAL SWITCH

BACKGROUND AND SUMMARY

The invention relates to a high speed electromagnetically actuated electromechanical switching unit. The switching unit is amenable to an electric remote control function, similar to a relay. In addition, the switching unit is amenable to local manual control.

The switching unit is characterized by its extremely fast operation. The unit requires less than one-half cycle of a 60 hertz AC line to turn ON, i.e. less than 0.008 seconds. The unit likewise requires less than one-half cycle of a 60 hertz AC line to turn OFF.

A single armature plunger reciprocally shuttles between magnetic paths. A pair of coils are energizable to create magnetic fluxes having portions of their linkage paths in common, including through the plunger. When either coil is energized, a flux path is created around that coil through the plunger, and another flux path is created around both coils through the plunger. The ratio of the permeances of the two paths is controlled such that one path always overpowers the other, to insure plunger movement in either direction to actuate bistable snap blade electrical contact means. The plunger is held in place by the snap blade until the net magnetic gradient overcomes the mechanical gradient of the snap blade, whereafter the system avalanches and is committed to switch.

In the preferred embodiment, the switching event is committed at 5 milliseconds after the application of current to the coil, and may be less, depending upon the phase of applied AC power. The switching event is completed in another 5 milliseconds, i.e. the contacts are closed, including bounce. Plunger movement in either direction occurs within 1 millisecond.

High speed operation of the switching unit is enabled by various features in combination. The mass of moving parts is minimized by the use of a single armature that shuttles between two magnetic paths. The contact system is of reduced mass and flexes about one end, thereby minimizing the inertia of a moving snap blade. A double Euler beam snap blade has a pair of cantilever arms extending towards each other to engage the armature plunger in the gap therebetween, which provides centering balance on the plunger which prevents lateral bias, which in turn reduces friction to thus increase speed.

The switching unit operates on either AC or DC current. The unit consumes no power when ON or OFF, and is mechanically held ON and OFF with zero holding energy. The unit is further characterized by its overall compactness and by low cost.

DETAILED DESCRIPTION

Figure 1:
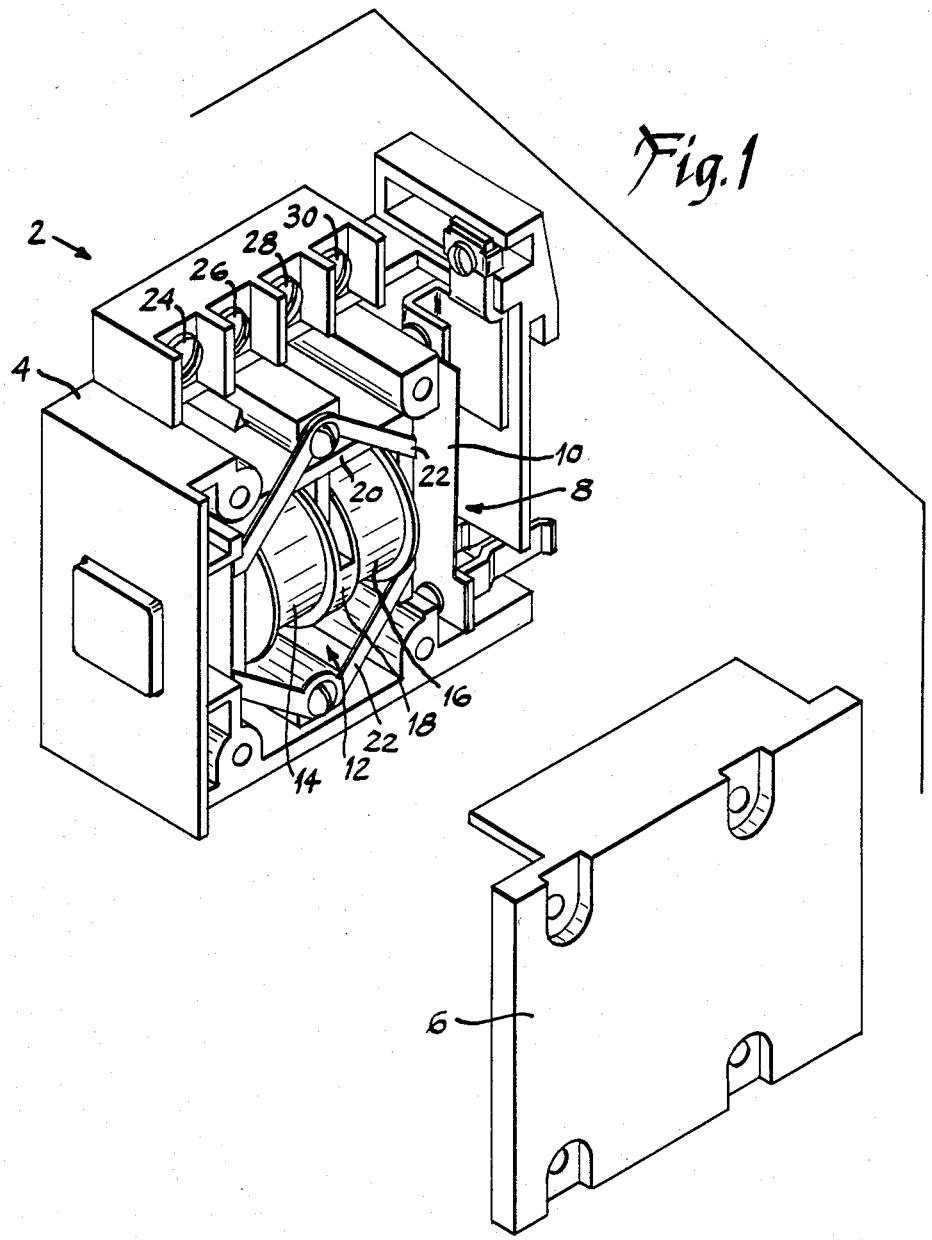
FIG. 1 is an exploded isometric view of an electromagnetically actuated electromechanical switching unit constructed in accordance with the invention.

FIG. 1 shows an electromagnetically actuated electromechanical switch 2. Housing 4 has its front cover 6 removed to show electrical contact means 8 in the housing, including bistable snap blade means 10 operable between different circuit positions, and electromagnetic actuator means 12 mounted in the housing for actuating snap blade 8. Electromagnetic actuator 12 includes a pair of coaxial coils 14 and 16 mounted on an insulating bobbin 18 secured within a magnetically permeable yoke 20 and supported in housing 4 by supports 22. Left coil 14 is energized at terminals 24 and 26, and right coil 16 is energized at terminals 28 and 30.

Figure 2:
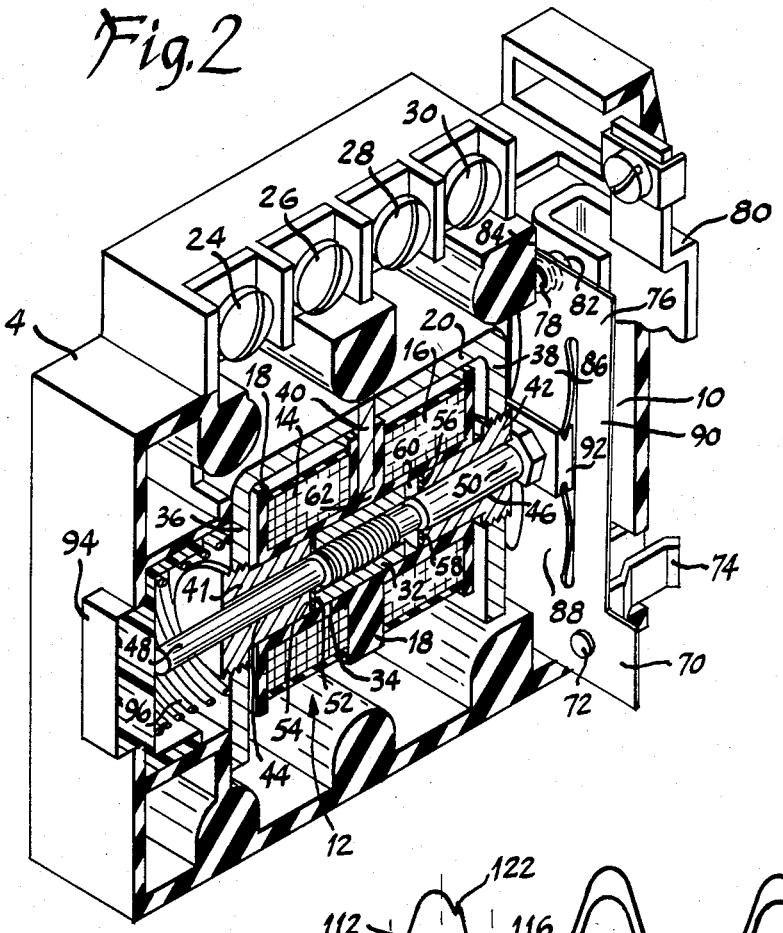
FIG. 2 is a cutaway isometric view of the switching unit of FIG. 1.

Referring to FIG. 2, electromagnetic actuator 12 includes an armature plunger 32 which reciprocally shuttles axially left and right. Bobbin 18 has an axial passage 34 therethrough for guiding movement of plunger 32. Yoke 20 is a magnetically permeable E-shaped member having left and right outer legs 36 and 38 on opposite ends of the coils, and a center leg 40 between the coils. The yoke further includes left and right magnetically permeable insets 41 and 42 screwed into left and right outer legs 36 and 38 and directing the flux path back inwardly. The insets have respective axial bores 44 and 46 for guiding axial left-right movement of plunger extension shafts 48 and 50 secured to the central segment of the plunger in threaded relation. A nonmagnetic spacer washer 52 abuts the inner edge 54 of yoke inset 41, and another nonmagnetic spacer washer 56 abuts the inner edge 58 of yoke inset 42. Inner edge 54 and spacer washer 52 form a shoulder stop limiting axial leftward movement of plunger 32 as shown in FIG. 2. Spacer washer 56 and edge 58 provide a rightward shoulder stop limiting rightward axial movement of plunger 32.

When plunger 32 is in its leftward position in FIG. 2, the right coil 16 is energized, a primary magnetic flux path is created around energized coil 16 and a secondary magnetic flux path is created around both coils 14 and 16. The primary flux path extends through right outer yoke leg 38, through yoke inset 42, through axial magnetic air gap 60, through plunger 32, through radial gap 62 across bobbin 18 between plunger 32 and central yoke leg 40, through center yoke leg 40, and back to right outer yoke leg 38 to complete the primary loop. The secondary flux path extends through right outer yoke leg 38, through yoke inset 42, through axial gap 60, through plunger 32, through spacer washer 52 and shoulder stop edge 54, through inset 41, through left outer yoke leg 36, and back across the top of the yoke to right outer yoke leg 38, to complete the secondary loop. The primary path flux force attracts plunger 32 rightwardly to close axial gap 60 and open a gap between plunger 32 and washer 52 abutting stop shoulder edge 54. The secondary path flux force attracts the plunger in the opposite direction to remain in its leftward position.

The ratio of the permeances of the primary and secondary flux path forces is controlled to insure that one path always overpowers the other, to thus insure plunger movement in either direction, and in the intended direction according to energization of either coil. The ratio of the radial width of gap 62 to the axial width of spacer 52 sets the ratio of the primary and secondary flux forces when right coil 16 is energized. This controls the net magnitude and direction of force on plunger 32 upon energization of right coil 16. The structure is symmetric, and thus when plunger 32 is in its rightward position and left coil 14 is energized, the ratio of the radial width of gap 62 and the axial width of spacer 56 sets the ratio of the primary and secondary flux forces whereby to control the net magnitude and direction of force on plunger 32 upon energization of left coil 14. The ratio of the noted widths may be determined empirically, or mathematically by simultaneous solution of Gaussian equations. In one implementation, the width of radial gap 62 is 0.012 inch and the width of each of spacers 52 and 56 is 0.010 inch.

Armature shuttle plunger 32 is thus reciprocal in housing 4 between left and right positions respectively closing and opening first and second gaps between plunger 32 and yoke 20 at inset stop shoulders 54 and 58. Plunger 32 is in overlapping flux paths in each of its left and right positions. Energization of the right coil 16 creates a primary flux around the latter attracting the plunger to its rightward position to close right gap 60 and open a left gap between the left edge of plunger 32 and spacer 52 against left shoulder stop 54. Energization of right coil 16 also creates a secondary flux around both coils attracting plunger 32 to remain in its leftward position with the left gap closed and the right gap 60 open. Energization of left coil 14 creates a primary flux around the latter attracting plunger 32 to its leftward position to close the left gap and open the right gap 60, and creates a secondary flux around both coils attracting plunger 12 to remain in its rightward position with the right gap 60 closed and the left gap open. The force on plunger 32 from the primary flux path around either coil is always stronger than the force on the plunger from the secondary path.

Electrical snap blade means 10 is a planar flexible spring member having bottom end 70 rigidly mounted in fixed relation in housing 4, for example by rivet holes such as 72. A lower terminal 74 extends through the housing and ohmically engages the bottom end 70 of the blade. Blade 10 has an upper free end 76 having a contact 78 thereon for making and breaking a circuit connection to upper terminal 80 extending through the housing. Snap blade means 10 has a first stable position with upper free end 76 in a rightward position and contact 78 engaging and stopped against contact 82 of terminal 80. Snap blade means 10 has a second stable position with upper free end 76 in a leftward position stopped against housing edge 84.

Snap blade means 10 includes double Euler beams formed by a pair of cantilever arms 86 and 88 extending from a respective one of the top and bottom ends 76 and 70 towards each other to a gap therebetween. The top and bottom ends of the blade are connected by a pair of outer side segments, one of which 90 is seen in FIG. 2, and between which cantilever arms 86 and 88 extend in parallel relation. Extension shaft 50 of plunger 32 extends into the gap between cantilever arms 86 and 88. The right end of plunger shaft 50 includes an insulating segment 92 engaging the cantilever arms 86 and 88 between the facing edges thereof.

In the position shown in FIG. 2, plunger 32 is in its leftward position, cantilever arms 86 and 88 are bowed leftwardly, and top free blade end 76 is in its rightward stable position. When plunger 32 and shaft extension 50 move rightwardly, cantilever arms 86 and 88 are flexed and store potential energy. When these arms are moved through center, the stored energy is released and top free end 76 snaps leftwardly against housing edge 84 to interrupt the circuit between terminals 80 and 74. Plunger 32 is then in its rightward position against spacer 56 and right shoulder stop 58, with gap 60 closed, and a left axial gap opened between the left edge of plunger 32 and shoulder stop 54. A manual override is provided by push button 94 which can be depressed to drive plunger 32 and its shaft extensions rightwardly to thus manually actuate snap blade means 10 to an off condition. Return spring 96 biases button 94 leftwardly.

Figure 3:
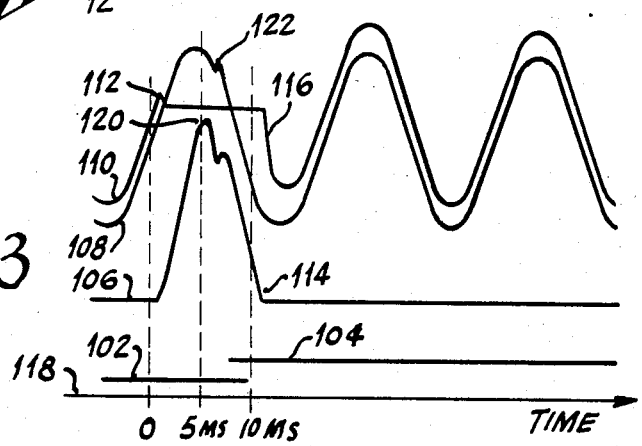
FIG. 3 is a schematic diagram of an oscilloscope trace for illustrating the high speed mechanical switching of the invention.

FIG. 3 shows the contacts going from an open condition at 102 to a closed condition at 104. Trace 106 is the wave shape of the current flow through the energized coil. Trace 108 is the voltage trace of the nonenergized coil. Trace 110 is the voltage trace of the energized coil. The voltage trace of the energized coil rises up to point 112 at which time the current flow therethrough holds the voltage stable until the current is terminated at 114 and the voltage again tracks the input voltage as shown at point 116. As seen on the time scale 118, coil current starts at time zero, and the contacts close and settle, including bounce, in less than 10 milliseconds. The overlap between traces 102 and 104 is contact bounce and takes about 2.5 milliseconds. The switching event is thus complete in less than 10 milliseconds.

The switching event is committed after 5 milliseconds, which is the peak of the coil current at 120. When the voltage is applied at time zero, the current in the coil rises exponentially, and the force on the plunger also rises exponentially. The plunger and snap blade feel the rise in force but are held in place by the mechanical gradient of the snap blade means 10. When the magnetic gradient of the electromagnetic actuator 12 overcomes the mechanical gradient, the system avalanches. Coil current need not be applied for the full duration of the switching time. It is only necessary that enough energy be stored in the magnetic gap, for example gap 60, to equal the energy stored in the mechanical sanp blade means 10. Once this has occurred, the system is committed to switch. This committed switching point occurs after 5 milliseconds, and is thus less than one-half cycle of a 60 hertz AC line. The magnetic circuit is about twice as fast as the overall contact switching event. From the time current is applied to the coil, it takes about 5 milliseconds to build up enough voltage to cause the armature plunger 32 to trip, and another 5 milliseconds for the contacts to close, including bounce.

The small blip 122 is trace 108 for the nonenergized coil is a particularly desirable feature. It represents an induced voltage in the nonenergized coil caused by movement of armature plunger 32. The level of this induced voltage is about 10 volts and is particularly useful as an indication that the plunger has in fact moved. This feedback verification of plunger actuation is afforded using existing flux linkage paths, without the need for additional sensing circuitry. Blip 122 further is a measure of the actuation time of armature plunger 32 which is about 1 millisecond. The time needed for power to be applied to the coil may be less than 5 milliseconds, depending on the phase.

It is recognized that various modifications are possible within the scope of the appended claims.

We claim:

1. A high speed electromagnetically actuated electromechanical switch combination, comprising:

a housing;

electrical contact means in said housing, including bistable snap blade means operable between different circuit positions;

a pair of coaxial coils in said housing energizable to create magnetic flux;

a shuttle plunger in said housing axially movable between first and second positions to actuate said snap blade means;

magnetically continuous yoke means in said housing for directing the flux paths of said coils, said yoke means having a first portion spaced from said plunger by a first axial gap when said plunger is in said second position, said yoke means having a second portion spaced from said plunger by a second axial gap when said plunger is in said first position, said yoke means having a third portion spaced from said plunger by a third gap in each of said first and second plunger positions;

such that when said plunger is in said second position and said first coil is energized, a primary flux path is created and extends around said first coil through said yoke means and said plunger and across said first and third gaps, and a secondary flux path is created and extends around both said coils through said yoke means and said plunger and across said first gap, said primary path flux force attracting said plunger to said first position to close said first gap, said secondary path flux force attracting said plunger to remain in said second position; and such that when said plunger is in said first position and said second coil is energized, a primary flux path is created and extends around said coil through said yoke means and said plunger and across said second and third gaps, and a secondary flux path is created and extends around both said coils through said yoke means and said plunger and across said second gap, said last mentioned primary path flux force attracting said plunger to said second position to close said second gap, said last mentioned secondary path flux force attracting said plunger to remain in said first position, the flux paths from the axial ends of said plunger extending substantially only axially through respective said first and second gaps to said yoke means, said third portion of said yoke means being a central leg extending radially between said coils, said leg having an inner end facing said plunger and separated radially therefrom by said third gap, the axial length of said third gap being no greater than the axial spacing of said coils, the force on said plunger from said primary flux around either said coil always being stronger than the force on said plunger from said secondary flux, preventing residual magnetic latching, such that said plunger moves in either direction responsive to the primary flux in the open gap and actuates said snap blade means without the need for mechanical assistance;

first non-magnetic spacer means axially between said yoke means and said plunger in said first position, the ratio of the axial width of said spacer means to the radial width of said third gap setting the ratio of said second mentioned primary and secondary flux forces such that the primary flux force is greater than the secondary flux force, and the difference therebetween is greater than the mechanical gradient of said snap blade means; and second non-magnetic spacer means axially between said yoke means and said plunger in said second position, the ratio of the axial width of said second spacer means to the radial width of said third gap setting the ratio of said first mentioned primary and secondary flux forces such that the primary flux force is greater than the secondary flux force, and the difference therebetween is greater than the mechanical gradient of said snap blade means.

2. An electromagnetically actuated electromechanical switch, comprising:

a housing;

electrical contact means mounted in said housing, including bistable snap blade means comprising a flexible member rigidly mounted at one end in said housing and free at its other end for movement, and having an electrical contact at said other end, and including double Euler beams formed by a pair of cantilever arms each extending from a respective one of said ends towards each other to a gap therebetween; and magnetic actuator means mounted in said housing and including a movable plunger extending into said gap and engaging said cantilever arms to actuatingly flex said snap blade means between bistable overcenter snap-action positions, said cantilever arms being bowed in one direction in a first stable position and being bowed in the opposite direction in the other alternate stable position, wherein said ends of said flexible member are connected by a pair of planar outerside segments, and wherein said movable plunger engages and flexes said cantilever arms such that the latter flex and bow, without bowing or flexing of said plunger, said flexed and bowed cantilever arms storing potential energy and supplying snap-action force;

wherein said actuator means comprises:

a pair of coaxial coils in said housing energizable to create magnetic flux;

said movable plunger being a shuttle plunger in said housing axially movable between first and second positions corresponding to circuit positions of said snap blade means;

magnetically continuous yoke means in said housing for directing the flux paths of said coils, said yoke means having a first portion spaced from said plunger by a first axial gap when said plunger is in said second position, said yoke means having a second portion spaced from said plunger by a second axial gap when said plunger is in said first position, said yoke means having a third portion spaced from said plunger by a third gap in each of said first and second plunger positions;

such that when said plunger is in said second position and said first coil is energized, a primary flux path is created and extends around said first coil through said yoke means and said plunger and across said first and third gaps, and a secondary flux path is created and extends around both said coils through said yoke means and said plunger and across said first gap, said primary path flux force attracting said plunger to said first position to close said first gap, said secondary path flux force attracting said plunger to remain in said second position; and such that when said plunger is in a first position and said second coil is energized, a primary flux path is created and extends around said second coil through said yoke means and said plunger and across said second and third gaps, and a secondary flux path is created and extends around both said coils through said yoke means and said plunger and across said second gap, said last mentioned primary path flux force attracting said plunger to said second position to close said second gap, said last mentioned secondary path flux force attracting said plunger to remain in said first position, the flux paths from the axial ends of said plunger extending substantially only axially through respective said first and second gaps to said yoke means, said third portion of said yoke means being a central leg extending radially between said coils, said leg having an inner end facing said plunger and separated radially therefrom by said third gap, the axial length of said third gap being no greater than the axial spacing of said coils, the force on said plunger from said primary flux around either said coil always being stronger than the force on said plunger from said secondary flux, preventing residual magnetic latching, such that said plunger moves in either direction responsive to the primary flux in the open gap and actuates said snap blade means without the need for mechanical assistance;

and comprising:

first non-magnetic spacer means axially between said yoke means and said plunger in said first position, the ratio of the axial width of said spacer means to the radial width of said third gap setting the ratio of said second mentioned primary and secondary flux forces such that the primary flux force is greater than the secondary flux force, and such that the difference therebetween is greater than the mechanical gradient of said snap blade means whereby to insure actuation of said snap blade means; and second non-magnetic spacer means between said yoke means and said plunger in said second position, the ratio of the axial width of said second spacer means to the radial width of said third gap setting the ratio of said first mentioned primary and secondary flux forces such that the primary flux force is greater than the secondary flux force, and such that the difference therebetween is greater than the mechanical gradient of said snap blade means whereby to insure actuation of said snap blade means.

3. An electromagnetically actuated electromechanical switch, comprising:

a housing;

electrical contact means mounted in said housing, including bistable snap blade means operable between different circuit positions;

a pair of coils coaxially mounted in said housing and energizable to create magnetic flux;

magnetically continuous yoke means in said housing for directing the flux paths of said coils; and a shuttle plunger axially reciprocal in said housing between first and second positions according to energization of a respective said coil providing a primary flux path around the respective said coil through said yoke means and said plunger, and providing a secondary flux path around both said coils through said yoke means and said plunger, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils, such that the primary flux force around either coil is always stronger than the secondary path, preventing residual magnetic latching and insuring plunger movement from either said position without the need for mechanical assistance, said plunger engaging said snap blade means in actuating relation to operate the latter between said circuit positions corresponding to said first and second positions;

wherein:

said yoke means includes first and second axially spaced stop shoulders for limiting said axial movement of said plunger at respective said first and second positions corresponding to said circuit positions of said snap blade means;

such that when said plunger is in said second position and said first coil is energized, said primary flux path extends around said first coil through said yoke means and across an axial gap between said first stop shoulder of said yoke means and said plunger and through said plunger and across said radial gap between said plunger and said central leg of said yoke means, and said secondary path extends around both said coils through said yoke means and across said axial gap between said first stop shoulder of said yoke means and said plunger and through said plunger and through said second stop shoulder of said yoke means; and such that when said plunger is in said first position and said second coil is energized, said primary flux path extends around said second coil through said plunger and across an axial gap between said second stop shoulder of said yoke means and said plunger and through said plunger and across said radial gap between said plunger and said central leg of said yoke means, and said secondary path extends around both said coils through said yoke means and across said axial gap between said second stop shoulder of said yoke means and said plunger and through said plunger and through said first stop shoulder of said yoke means;

and comprising first non-magnetic spacer means axially between said plunger and said first stop shoulder of said yoke means, and second non-magnetic spacer means axially between said plunger and said second stop shoulder of said yoke means, and wherein said yoke means comprises noncylindrical E-shaped means having first and second outer legs, and said central leg therebetween, said first coil being between said central leg and said first outer leg, said second coil being between said central leg and said second outer leg, said central leg being a narrow member with a non-flared inner end radially facing said plunger across said radial gap and defining the axial length of said radial gap to a dimension no greater than the axial space between said coils;

wherein:

said plunger slides along said axis between said first and second shoulder stops, with said gap between said plunger and said central leg of said E-shaped yoke means remaining the same;

said gap between said first shoulder stop and said plunger in said second position is set by the axial width of said second spacer means; and said gap between said second shoulder stop and said plunger in said first position is set by the axial width of said first spacer means;

energization of said first coil, when said plunger is in said second position, creates said primary path flux force attracting said plunger to said first position closing the gap between said plunger and said first shoulder stop, and creates said secondary path flux force attracting said plunger to remain in said second position;

the ratio of the radial width of said gap between said plunger and said central leg of said E-shaped yoke means to the axial width of said second spacer means setting the ratio of said last mentioned primary and secondary flux forces whereby to control the net magnitude and the direction of force on said plunger upon energization of said first coil;

energization of said second coil, when said plunger is in said first position, creates said primary path flux force attracting said plunger to said second position closing the gap between said plunger and said second shoulder stop, and creates said secondary path flux force attracting said plunger to remain in said first position; and the ratio of the radial width of said gap between said plunger and said central leg of said E-shaped yoke means to the axial width of said first spacer means setting the ratio of said last mentioned primary and secondary flux forces whereby to control the net magnitude and direction of force on said plunger upon energization of said second coil.

4. The invention according to claim 3 wherein said bistable snap blade means remains stable and holds said plunger in said first or second position until the mechanical gradient of said snap blade means is overcome by the net magnetic gradient on said plunger.

* * * * *